US011814941B2

(12) United States Patent
Mehta

(10) Patent No.: US 11,814,941 B2
(45) Date of Patent: Nov. 14, 2023

(54) PROCESS FOR CONTROLLED IN-SITU COAL GASIFICATION AND A FILLING DEVICE TO OPERATE THE SAME

(71) Applicant: Jayant Chandulal Mehta, Nagpur (IN)

(72) Inventor: Jayant Chandulal Mehta, Nagpur (IN)

(73) Assignee: JAYANT CHANDULAL MEHTA

( * ) Notice: Subject to any disclaimer, the term of this patent is extended or adjusted under 35 U.S.C. 154(b) by 0 days.

(21) Appl. No.: 17/629,828

(22) PCT Filed: Feb. 2, 2021

(86) PCT No.: PCT/IB2021/050810
§ 371 (c)(1),
(2) Date: Jan. 25, 2022

(87) PCT Pub. No.: WO2022/130032
PCT Pub. Date: Jun. 23, 2022

(65) Prior Publication Data

US 2023/0304387 A1 Sep. 28, 2023

(30) Foreign Application Priority Data

Dec. 18, 2020 (IN) ..... 202021055176

(51) Int. Cl.
*E21B 43/295* (2006.01)
*E21F 15/08* (2006.01)
(Continued)

(52) U.S. Cl.
CPC ..... *E21B 43/295* (2013.01); *E21B 43/243* (2013.01); *E21B 49/00* (2013.01); *E21F 15/005* (2013.01); *E21F 15/08* (2013.01)

(58) Field of Classification Search
CPC ..... E21B 43/295; E21B 43/243; E21B 49/00; E21F 15/005; E21F 15/08; E21C 41/18
See application file for complete search history.

(56) References Cited

U.S. PATENT DOCUMENTS 3,999,607 A * 12/1976 Pennington ..... E21B 43/18 166/266
4,306,621 A 12/1981 Boyd et al.
(Continued)

FOREIGN PATENT DOCUMENTS

CN 107152267 A 9/2017

*Primary Examiner* — Carib A Oquendo
(74) *Attorney, Agent, or Firm* — Jason C. Cameron

(57) ABSTRACT

A process for controlled in-situ coal gasification is disclosed. The process includes surveying one or more selected coal bearing sites for designing a plurality of panels; designing a plurality of sub-panels of a plurality of corresponding panels with a plurality of bi-directional boreholes and a plurality of vertical service boreholes; channelizing the plurality of bi-directional boreholes and vertical service boreholes to one or more layers of coal seams; constructing one or more coal slice areas of predefined dimensions within the one or more layers of the coal seams; combusting coal inside the one or more coal slice areas; extracting combusted coal from the one or more coal slice areas through the plurality of vertical service boreholes; monitoring physical condition of at least one cavity created by extraction of the combusted coal; controlling remote filling of a filling material simultaneously at the at least one cavity using the filling device.

10 Claims, 6 Drawing Sheets

(51) Int. Cl.

| | |
|---|---|
| ***E21F 15/00*** | (2006.01) |
| ***E21B 49/00*** | (2006.01) |
| ***E21B 43/243*** | (2006.01) |

(56) References Cited

U.S. PATENT DOCUMENTS

| | | | | |
|---|---|---|---|---|
| 7,516,784 | B2 | 4/2009 | Maguire | |
| 2013/0061592 | A1* | 3/2013 | Mehta | E21B 43/30 60/648 |
| 2013/0312950 | A1* | 11/2013 | Shaikh | E21B 43/243 166/59 |

* cited by examiner

PROCESS FOR CONTROLLED IN-SITU COAL GASIFICATION AND A FILLING DEVICE TO OPERATE THE SAME

CROSS-REFERENCE TO RELATED APPLICATION

This National Phase Application claims priority from a complete patent application filed in India having Patent Application No. 202021055176, filed on Dec. 18, 2020 and titled "A PROCESS FOR CONTROLLED IN-SITU COAL GASIFICATION AND A FILLING DEVICE TO OPERATE THE SAME".

BACKGROUND

Embodiments of the present disclosure relate to an underground coal mining process and more particularly to a process for controlled in-situ coal gasification and a filling device to operate the same.

Coal is a principal source of energy resource available in the world. The coal is used for one or more purposes such as a chemical source from which numerous synthetic compounds are derived, in production of coke for metallurgical processes, for production of electrical power using steam generation and the like. In addition, gasification and liquefaction of coal produce gaseous and liquid fuels that is easily transported and conveniently stored in tanks. For several utilization purposes of the coal, a need for conservation and optimization of all carbon generating energy resources are attracting the center stages at all international forums. Also, the need for the optimum utilization of the available source of energy with minimal greenhouse gas production is of utmost necessity. Generally, the minimal greenhouse gas production is possible by controlled gasification process of the coal. Various coal gasification processes are available which helps in gasification of the coal by following one or more mining approaches.

Conventionally, an underground coal gasification process (UCG) is used to extract energy from one or more coal seams. The UCG process gasifies the coal and generates syngas, which is further utilized as fuel for power generation, chemical feedstock, gas to liquids fuel conversion or fertilizer. However, such a conventional gasification process involves, pyrolysis process which produces one or more chemicals that become serious contaminants if such one or more chemicals escape out from a gasification cavity into the surrounding environment. Also, such a conventional gasification process is unable to provide certainty of controlled combustion and containment and/or removal of the one or more chemicals from the environment. Moreover, such a conventional UCG process includes involvement of one or more UCG pilots in different parts of world which are generally unsuccessful in controlling combustion and preventing release of toxic chemicals into the environment and does not help in overcoming these obstacles and facilitate commercialization of UCG.

Hence, there is a need for an improved controlled in-situ coal gasification process and a filling device to operate the same in order to address the aforementioned issues.

BRIEF DESCRIPTION

In accordance with an embodiment of the present disclosure, a process for controlled in-situ coal gasification is disclosed. The process includes surveying one or more selected coal bearing sites using one or more surveying techniques for designing a plurality of panels of predetermined dimensions. The process also includes designing a plurality of sub-panels of a plurality of corresponding panels designed, wherein the plurality of sub-panels of predefined dimensions are designed with a plurality of bi-directional boreholes and a plurality of vertical service boreholes. The process also includes channelizing the plurality of bi-directional boreholes and the plurality of vertical service boreholes to one or more layers of coal seams. The process also includes constructing one or more coal slice areas of predefined dimensions within the one or more layers of the coal seams with a principal area of coal extraction. The process also includes combusting coal inside the one or more coal slice areas using a control retreating ignition point technology. The process also includes extracting combusted coal from the one or more coal slice areas through the plurality of vertical service boreholes. The process also includes monitoring physical condition of at least one cavity created by extraction of the combusted coal from the one or more coal slice areas using an image acquisition device equipped with a filling device. The process also includes controlling remote filling of a filling material simultaneously at the at least one cavity using the filling device based on a monitored physical condition of the at least one cavity, wherein the filling device is plunged into the one or more coal slice areas via the plurality of bi-directional boreholes.

In accordance with another embodiment of the present disclosure, a remote filling device fir controlled in situ coal gasification is disclosed. The device includes a material filling component configured to control addition of one or more substances of a filling material in a predefined proportion. The device also includes an image acquisition device affixed with the material filling component, wherein the image acquisition device is configured to capture one or more images of at least one cavity created in one or more coal slice areas for assisting in remote filling of the at least one cavity. The device also includes an elbow component mechanically coupled to the material filling component, wherein the elbow component is configured to plunge the filling material into the at least one cavity created in the one or more coal slice areas based on the one or more images of the at least one cavity captured. The device also includes one or more illuminative sources configured to generate a predefined intensity of light for illuminating and guiding plunging of the filling material into the at least one cavity of the one or more coal slice areas.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1:
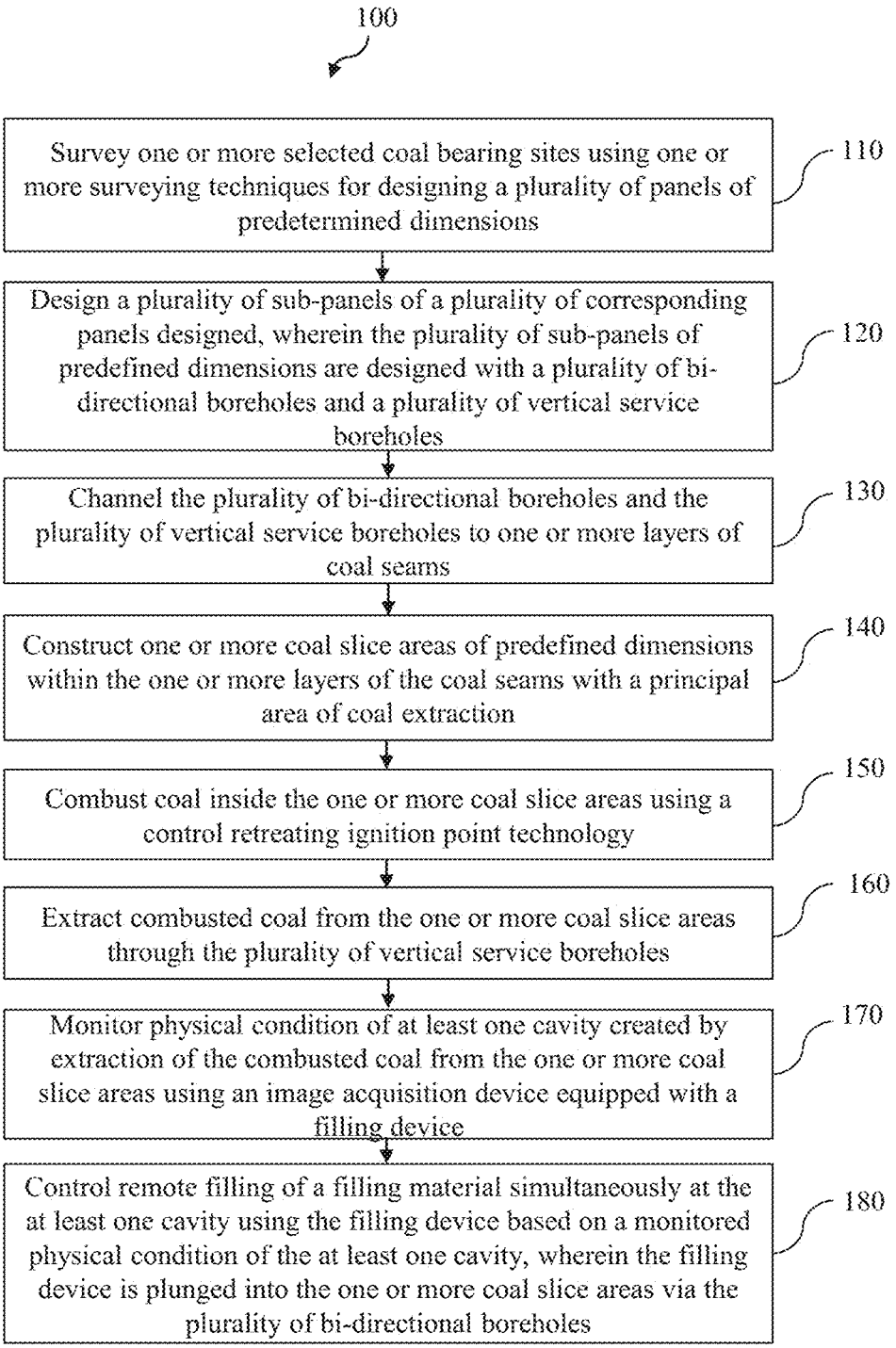
FIG. 1 represents a flow chart illustrating the steps involved in a process for controlled in-situ coal gasification in accordance with the embodiment of the present disclosure.

Further, those skilled in the art will appreciate that elements in the figures are illustrated for simplicity and max not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to a process for controlled in-situ coal gasification. The process includes surveying one or more selected coal bearing sites using one or more surveying techniques for designing a plurality of panels of predetermined dimensions. The process also includes designing a plurality of sub-panels of a plurality of corresponding panels designed, wherein the plurality of sub-panels of predefined dimensions are designed with a plurality of bi-directional boreholes and a plurality of vertical service boreholes. The process also includes channelizing the plurality of bi-directional boreholes and the plurality of vertical service boreholes to one or more layers of coal seams. The process also includes constructing one or more coal slice areas of predefined dimensions within the one or more layers of the coal seams with a principal area of coal extraction. The process also includes combusting coal inside the one or more coal slice areas using a control retreating ignition point technology. The process also includes extracting combusted coal from the one or more coal slice areas through the plurality of vertical service boreholes. The process also includes monitoring physical condition of at least one cavity created by extraction of the combusted coal from the one or more coal slice areas using an image acquisition device equipped with a filling device. The process also includes controlling remote filling of a filling material simultaneously at the at least one cavity using the filling device based on a monitored physical condition of the at least one cavity, wherein the filling device is plunged into the one or more coal slice areas via the plurality of bi-directional boreholes.

FIG. 1 represents a flow chart 100 illustrating the steps involved in a process for controlled in-situ coal gasification in accordance with the embodiment of the present disclosure. The process 100 includes surveying one or more selected coal bearing sites using one or more surveying techniques for designing a plurality of panels of predetermined dimensions in step 110. In one embodiment, surveying techniques may include at least one of a geological surveying technique, a hydrogeological surveying technique, a geo-mechanical surveying technique or a combination thereof.

As used herein, the term 'plurality of panels' is defined as a plurality of distinct sections formed for mining of coal from a coal bearing area. In one embodiment, the plurality of panels is designed based on consideration of a plurality of designing factors, wherein the plurality of designing factors may include at least one of abandoned mines condition, a type of mining method used for coal extraction, a period of fall, a seam density, a geo hydrological survey report, a mines development condition or a combination thereof. In such embodiment, the plurality of panels of the predetermined dimensions is designed based on consideration of a plurality of designing factors. In such embodiment, the plurality of designing factors max include at least one of abandoned mines condition, a type of mining method used for coal extraction, an area of periodical fall, a seam density, a geo mechanical survey report, hydrological survey report, a mines development condition or a combination thereof.

The process 100 also includes designing a plurality of sub-panels of a plurality of corresponding panels designed, wherein the plurality of sub-panels of predefined dimensions are designed with a plurality of bi-directional boreholes and a plurality of vertical service boreholes in step 120. In one embodiment, the plurality of subpanels may include a dimension of length two hundred meter and a breadth thirty meter respectively. In such embodiment, each of a panel among the plurality of panels may include seven number of sub-panels. Each of the plurality of panels are separated by airtight isolation. The plurality of panels preparation facilitates sub-surface dewatering and uninterrupted working of panel due to water problem especially in case where aquifers are present. The extraction of the plurality of panels in line of extraction reduces the isolation work in companion panels. Also, the plurality of panels and the plurality of sub-panels are designed by considering panel size or sub-panel size is such a manner so that preparation cost is least, and extraction is economical. Presence of geological disturbances faults, folds are also considered for designing the plurality of panels and the plurality of subpanels. One such embodiment of schematic representation of a panel with a plurality of sub-panels for controlled in-situ coal gasification is shown in FIG. 2.

Figure 2:
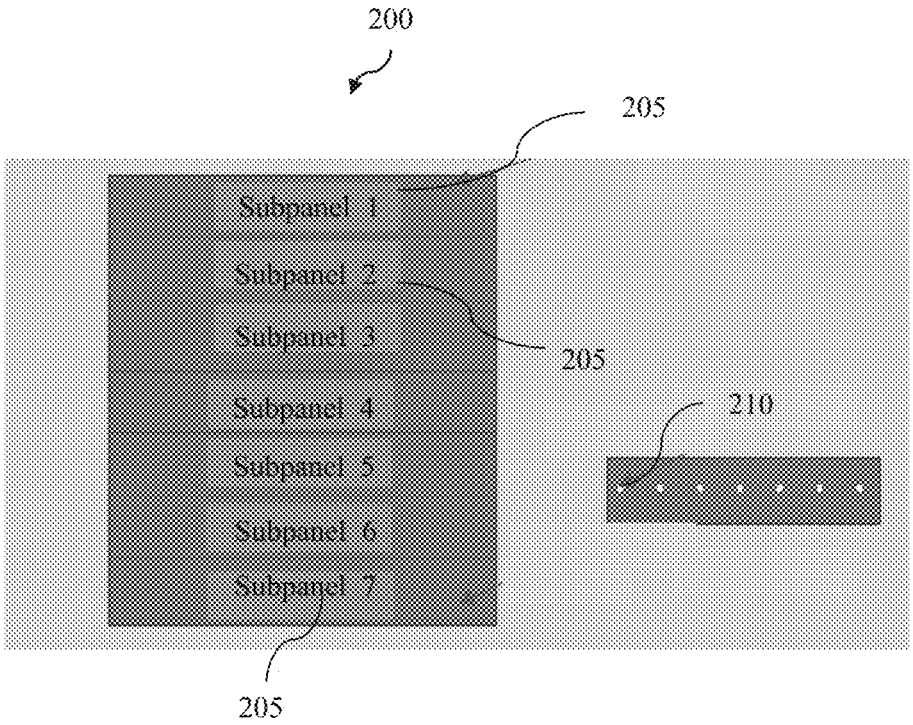
FIG. 2 represents a schematic representation of a panel with a plurality of sub-panels and a plurality of boreholes in accordance with an embodiment of a present disclosure.

FIG. 2 represents a schematic representation of a panel with a plurality of sub-panels and a plurality of boreholes in accordance with an embodiment of a present disclosure. The plurality of sub-panels 205 of predefined dimensions is designed within each of the plurality of panels 200. The plurality of sub-panels 205 on the surfaces includes the plurality of boreholes 210 wherein the plurality of boreholes 210 is used as production boreholes for coal extraction.

Referring to FIG. 1, the process 100 also includes channelizing the plurality of bi-directional boreholes and the plurality of vertical service boreholes to one or more layers of coal seams in step 130. In one embodiment, the channelizing the plurality of bi-directional boreholes and the plurality of bi-directional boreholes may include underground channeling of the plurality of boreholes at bottom level of coal present in the one or more layers of the coal seams. In a specific embodiment, the plurality of bi-directional boreholes is designed based on a plurality of borehole designing factors. In such embodiment, the plurality of borehole designing factors may include at least one of a type of the filling material, a size of the filling material, a plunging technique used for the filling material, thickness of coal seam, density of coal seam, dip direction, area under fire, quantity of coal under fire, rate of filling of the filling material, strength of the filling mated al or a combination thereof.

After completing designing of the plurality of bi-directional boreholes based on the borehole designing factor, the plurality of vertical service boreholes is designed. The plurality of vertical service boreholes is isolated till complete development work. The plurality of vertical boreholes is used as exhaust. Similarly, the plurality of bi-directional boreholes is used as inlet borehole.

The process 100 also includes constructing one or more coal slice areas of predefined dimensions within the one or more layers of the coal seams with a principal area of coal extraction in step 140. Design of the one or more slice areas are such that at least one cavity or void area created by coal extraction is self-supporting that is without any roof fall. The area of coal extraction A of E is calculated by findings of Leo mechanical properties of roof rock mass. The coal combustion is kept within A of E with boreholes design for both the plurality of vertical service boreholes and the plurality of bi-directional boreholes, wherein the design includes numbers, diameter, spacing and placing within the each of the one or more coal slice areas. In one embodiment, the number of the one or more slice areas may include seven slice areas within a sub-panel. In some embodiment, the predetermined dimension of the one or more slice areas may include a length of 200 meter and a breadth of 30 meter. An embodiment of a side view of the coal slice area is represented in FIG. 3.

Figure 3:
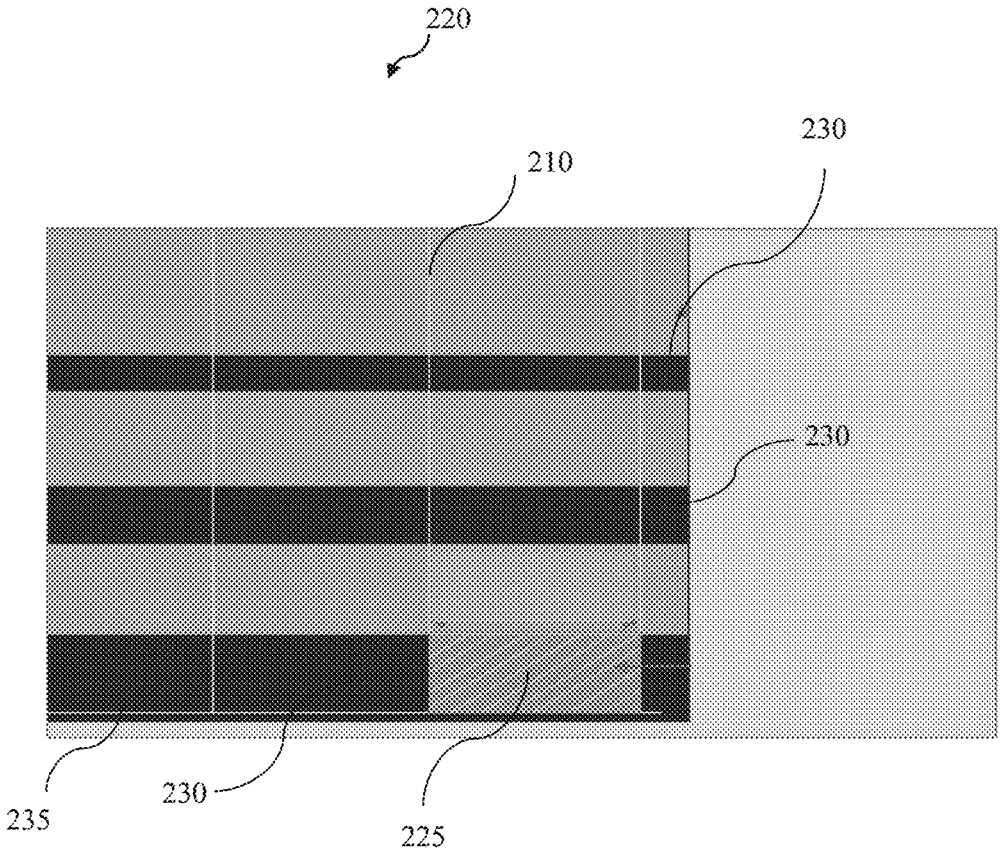
FIG. 3 represents a schematic representation of a side view of a coal slice area with one or more layers of coal seam in accordance with an embodiment of the present disclosure.

FIG. 3 represents a schematic representation of a side view 220 of a coal slice area 225 with one or more layers of coal seam 230 in accordance with an embodiment of the present disclosure. A coal slice area 225 of predefined dimension is constructed within the one or more layers of the coal seams 230. The coal slice area 225 receives the filling material via the plurality of bi-directional boreholes 235. Again, extraction of the coal from the coal slice area after coal combustion process is possible via the plurality of vertical service boreholes 210. A schematic representation of combustion process of the coal inside the coal slice area is depicted in FIG. 4.

Figure 4:
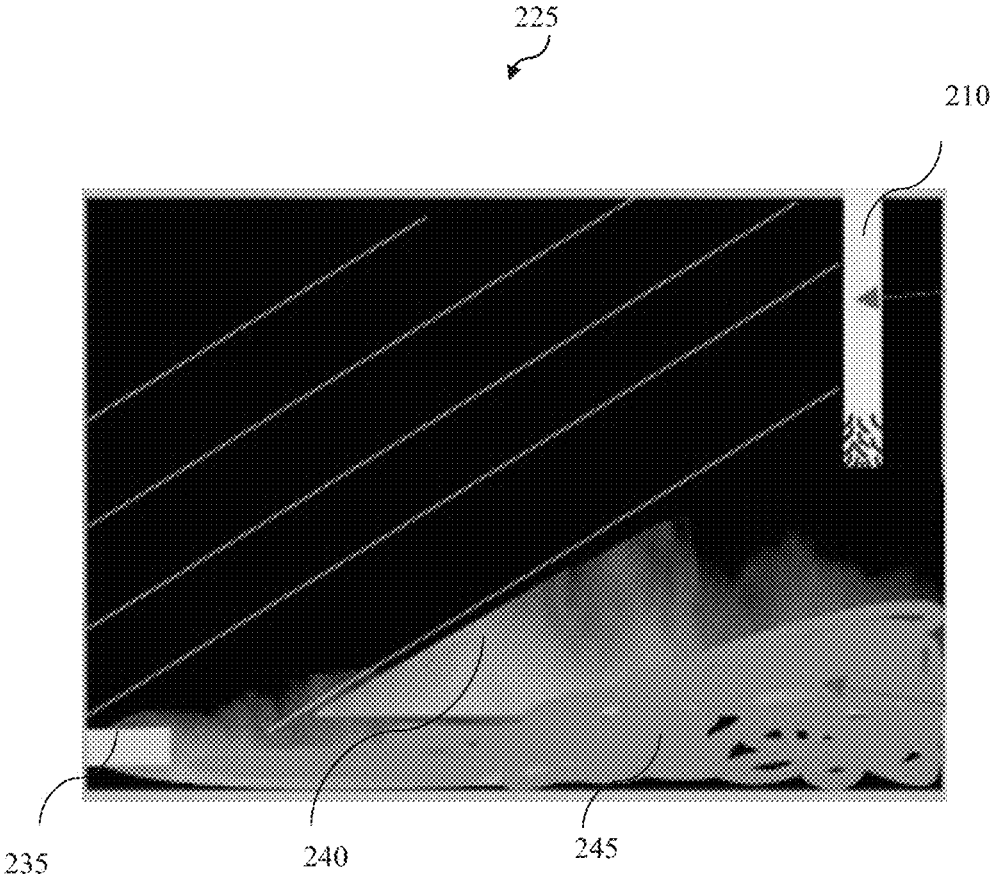
FIG. 4 depicts a schematic representation of an embodiment of combustion process of the coal inside the coal slice area in accordance with an embodiment of the present disclosure.

FIG. 4 depicts a schematic representation of an embodiment depicting combustion process 240 of the coal inside the coal slice area 225 in accordance with an embodiment of the present disclosure. The combustion process 240 of the coal inside the one or more coal slice areas 225 up to design width is arrested and achieved with simultaneous remote filling technology. The remote filling technology enables filling of the filling material such as ash 245 into the coal slice area via the plurality of bi-directional boreholes 235. Gaseous form of the coal upon combustion 240 is extracted out from the coal slice area via the plurality of vertical service boreholes 210.

Referring back to FIG. 1, the process 100 also includes combusting coal inside the one or more coal slice areas using a control retreating ignition point technology in step 150. The process 100 also includes extracting combusted coal from the one or more coal slice areas through the plurality of vertical service boreholes in step 160. By 'control reaction of ignition point' technology (CRIP) coal is ignited at bottom most portion of each of the coal slice areas. Ventilation of working area beside buoyancy is necessary by mechanical means as to control the quantity of coal on fire and quantity of heat generated and also to carry out the heat generated.

In case of surface coal seam fire. Fire site is not approachable easily as being deep seated. Heat generated by the coal combustion is not dissipated and as a result heats the embedding rock mass. Fire propagation develops in the coal seams because of a set of factors such as direction and wind speed, fracturing and temperature. The measure factor in uncontrolled fire spreading includes one or more technologies for firefighting which includes cut air supply or trenching to cut area under fire and ahead of fire propagation or to form a sufficient thickness of inert barrier by using the process of control in situ coal gasification. The process 100 also includes monitoring physical condition of at least one cavity created by extraction of the combusted coal from the one or more coal slice areas using an image acquisition device equipped with a filling device in step 170. In one embodiment, the physical condition of the at least one cavity may include at least one of performance of an underground reaction chamber, cavity growth corresponding to height of extraction or a combination thereof. The process 100 also includes controlling remote filling of a filling material simultaneously at the at least one cavity using the filling device based on a monitored physical condition of the at least one cavity, wherein the filling device is plunged into the one or more coal slice areas via the plurality of bi-directional boreholes in step 180. In one embodiment, the filling material may include at least one of fly-ash, cement slurry, gangue, loess, permeable material or a combination thereof. In such embodiment, the filling material is filled at the at least one cavity in a predefined filling rate, wherein the predefined filling rate is proportional to designed volume of the at least one cavity created by quantity of coal extraction.

An advanced development in remote filling to achieve controlled filling with help of the image acquisition device attached to the filling device in direction of 360 degrees and distance of 25 to 15 meters helps in controlled throw of the filling material and making airtight filling at roof. The advanced development makes the coal gasification process simpler as simultaneous filling of the one or more slice areas of by installing the filling device in the plurality of bi-directional boreholes and the retreating the same as filling progresses enables in achieving complete and compact filling. One such embodiment of controlled in-situ coal gasification process with the remote filling device is represented in FIG. 5.

Figure 5:
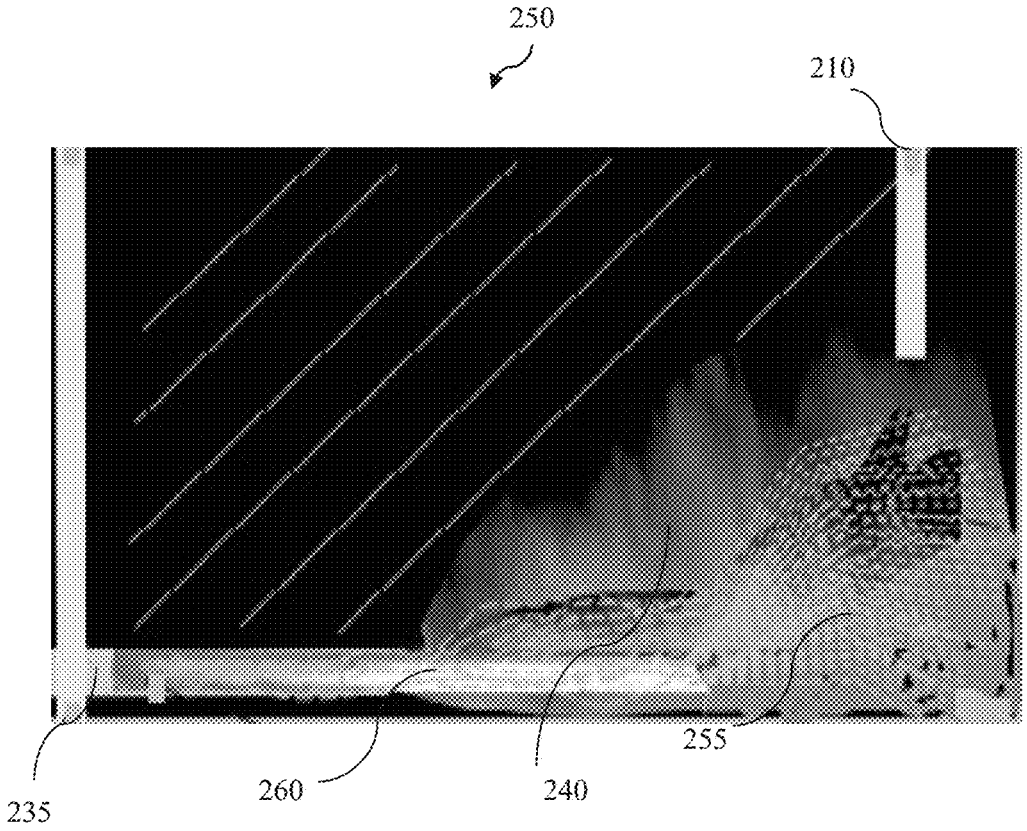
FIG. 5 represents the schematic representation of an embodiment of simultaneous filling of a coal slice area of a coal seam in accordance with an embodiment of a present disclosure.

FIG. 5 represents the schematic representation of an embodiment 250 of simultaneous filling of a coal slice area of a coal seam in accordance with an embodiment of a present disclosure. The slice simultaneous filling of the coal seam enables filling of the at least one cavity created in the coal slice area 225 by plunging of the filling material 255 simultaneously during coal extraction by a remote filling device 260. The filling material 255 is plunged into the coal slice area in a controlled manner via the plurality of bi-directional boreholes 235. Similarly, upon gasification, the coal is extracted via the plurality of vertical service boreholes 210. The plurality of vertical service boreholes 210 on a surface of the plurality of sub-panels are designed at predetermined distances so that they are properly channelized to a bottom layer of the coal seam.

Figure 6:
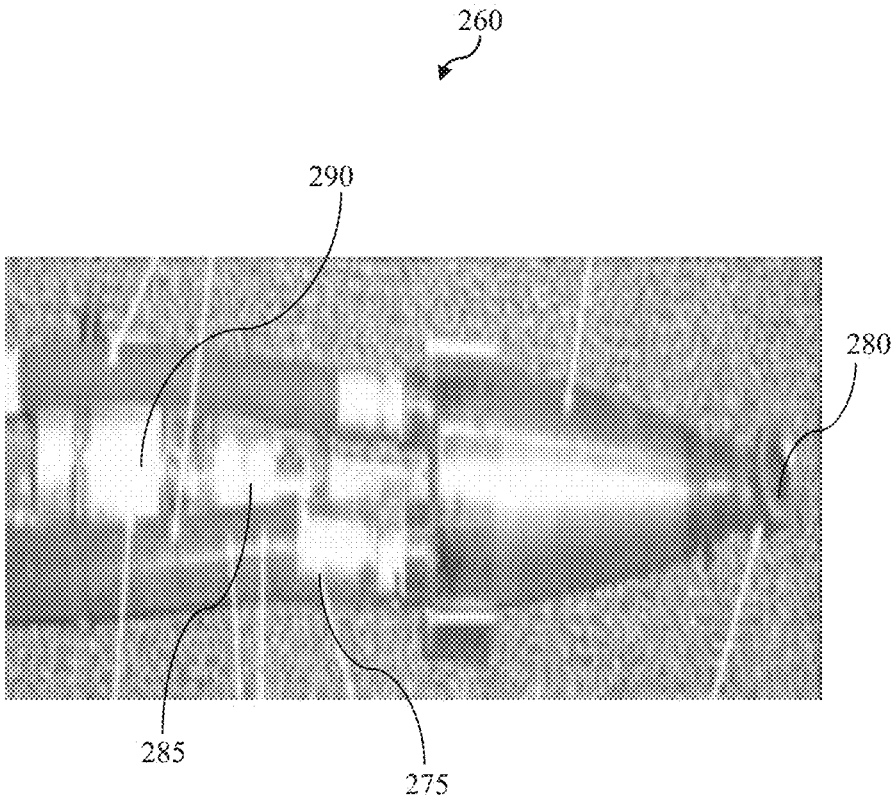
FIG. 6 is a schematic representation of a remote filling device for controlled in-situ coal gasification in accordance with an embodiment of the present disclosure.

FIG. 6 illustrates a schematic representation of an embodiment of a remote filling device 260 for controlled in situ coal gasification in accordance with an embodiment of a present disclosure. The device 260 includes a material filling component configured to control addition of one or more substances of a filling material 225 in a predefined proportion.

The device 260 also includes an image acquisition device 275 affixed with the material filling component (not shown in FIG. 6) respectively, wherein the image acquisition device 275 is configured to capture one or more images of at least one cavity created in one or more coal slice areas for assisting in remote filling of the at least one cavity. Remote filling using advanced filling technology where the image acquisition device such as cameras are used to achieve complete controlled directional filling of the filling material. The remote monitoring and filling technology gather information about cavity growth and performance of the underground reaction chamber so that desired amount of the filling material is applicable.

The device 260 also includes an elbow component 280 mechanically coupled to the material filling component (not shown in FIG. 6), wherein the elbow component 280 is configured to plunge the filling material into the at least one cavity created in the one or more coal slice areas based on the one or more images of the at least one cavity captured. The device 260 also includes one or more illuminative sources 285 configured to generate a predefined intensity of light for illuminating and guiding plunging of the filling material into the at least one cavity of the one or more coal slice areas. In one embodiment, the one or more illuminative sources 285 may include one or more high intensity light emitting diodes (LEDs). The device 260 also includes a battery component 290 configured to provide energy for operation of several components of the device 260 during the in-situ coal gasification.

Various embodiments of the present disclosure enable elimination of traditional coal mining methods and thereby reducing operating costs, surface damages and eliminates mine safety issues such as mine collapse and asphyxiation.

Moreover, the present disclosed process exploits the coal that are un-mineable as they are too deep, low grade, available at thin coal seams and greatly increasing domestic resource availability.

Furthermore, the present disclosed process enables no surface gasification, in which capital costs are substantially reduced and no coal is transported at the surface thereby reducing cost, emissions, and local footprint associated with coal shipping and stockpiling.

In addition, the present disclosed process utilizes remote monitoring and control of filling using advanced filling technology for arresting coal combustion where cameras are used to achieved complete control on directional filling by knowing the cavity growth and performance of the underground reaction chamber.

It will be understood by those skilled in the art that the foregoing general description and the following detailed description are exemplary and explanatory of the disclosure and are not intended to be restrictive thereof.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, the order of processes described herein may be changed and are not limited to the manner described herein. Moreover, the actions of any flow diagram need not be Implemented in the order shown; nor do all of the acts need to be necessarily performed. Also, those acts that are not dependent on other acts may be performed in parallel with the other acts. The scope of embodiments is by no means limited by these specific examples.

I claim:

1. A process for controlled in-situ coal gasification comprising:

surveying one or more selected coal bearing sites using one or more surveying techniques for designing a plurality of panels of predetermined dimensions;

designing a plurality of sub-panels of a plurality of corresponding panels designed, wherein the plurality of sub-panels of predefined dimensions are designed with a plurality of bi-directional boreholes and a plurality of vertical service boreholes;

channelizing the plurality of bi-directional boreholes and the plurality of vertical service boreholes to one or more layers of coal seams;

constructing one or more coal slice areas of predefined dimensions within the one or more layers of the coal seams with a principal area of coal extraction;

combusting coal inside the one or more coal slice areas using a control retreating ignition point technology;

extracting combusted coal from the one or more coal slice areas through the plurality of vertical service boreholes;

monitoring physical condition of at least one cavity created by extraction of the combusted coal from the one or more coal slice areas using an image acquisition device equipped with a filling device; and controlling remote filling of a filling material simultaneously at the at least one cavity using the filling device based on a monitored physical condition of the at least one cavity, wherein the filling device is plunged into the one or more coal slice areas via the plurality of bi-directional boreholes.

2. The process of claim 1, wherein the one or more surveying techniques comprising at least one of a geological surveying technique, a hydrogeological surveying technique, a geo-mechanical surveying technique or a combination thereof.

3. The process of claim 1, wherein the predetermined dimensions of the plurality of panels comprises a dimension of length two hundred meter and a breadth two hundred meter respectively.

4. The process of claim 1, wherein the plurality of panels is designed based on consideration of a plurality of designing factors, wherein the plurality of designing factors comprises at least one of abandoned mines condition, a type of mining method used for coal extraction, a period of fall, a seam density, a geo hydrological survey report, a mines development condition or a combination thereof.

5. The process of claim 1, wherein the physical condition of the at least one cavity comprises at least one of performance of an underground reaction chamber, cavity growth corresponding to height of extraction or a combination thereof.

6. The process of claim 1, wherein the filling material comprises at least one of fly-ash, cement slurry, gangue, loess, permeable material or a combination thereof.

7. The process of claim 1, wherein the plurality of bi-directional boreholes is designed based on a plurality of a borehole designing factors comprising at least one of a type of the filling material, a size of the filling material, a plunging technique used for the filling material, thickness of coal seam, density of coal seam, dip direction, area under fire, quantity of coal under fire, rate of filling of the filling material, strength of the filling material or a combination thereof.

8. The process of claim 1, wherein the filling material is filled at the at least one cavity in a predefined filling rate, wherein the predefined filling rate is proportional to designed volume of the at least one cavity created by quantity of coal extraction.

9. The process of claim 1, wherein the remote filling of the filling material creates a thick and inert barrier of noncombustible filling upon coal extraction and stopping propagation of fire by quenching the fire by use of coal energy.

10. A remote filling device for controlled in situ coal gasification comprising:

a material filling component configured to control addition of one or more substances of a filling material in a predefined proportion;

an image acquisition device affixed with the material filling component wherein the image acquisition device is configured to capture one or more images of at least one cavity created in one or more coal slice areas for assisting in remote filling of the at least one cavity;

an elbow component mechanically coupled to the material filling component, wherein the elbow component is configured to plunge the filling material into the at least one cavity created in the one or more coal slice areas based on the one or more images of the at least one cavity captured; and one or more illuminative sources configured to generate a predefined intensity of light for illuminating and guiding plunging of the filling material into the at least one cavity of the one or more coal slice areas.

* * * * *